US008347559B2

(12) United States Patent
Grazioso

(10) Patent No.: US 8,347,559 B2
(45) Date of Patent: Jan. 8, 2013

(54) STRUCTURE FOR OUTDOOR MARQUEES, PERGOLAS AND THE LIKE

(75) Inventor: Luca Grazioso, Frazione Sant'Atto (IT)

(73) Assignee: Corradi S.p.A., Bologna (IT)

( * ) Notice: Subject to any disclaimer, the term of this patent is extended or adjusted under 35 U.S.C. 154(b) by 313 days.

(21) Appl. No.: 12/654,406

(22) Filed: Dec. 18, 2009

(65) Prior Publication Data

US 2010/0162633 A1 Jul. 1, 2010

(30) Foreign Application Priority Data

Dec. 30, 2008 (EP) ..... 08425822

(51) Int. Cl.

| | |
|---|---|
| ***E04B 1/34*** | (2006.01) |
| ***E04B 7/00*** | (2006.01) |
| ***E04H 1/00*** | (2006.01) |
| ***E04H 3/12*** | (2006.01) |
| ***E04H 12/28*** | (2006.01) |

(52) U.S. Cl. ..... 52/73; 52/11; 52/79.6; 52/198; 160/22; 160/45

(58) Field of Classification Search ..... 52/198, 52/73, 75, 78, 3, 11, 74, 90.1, 302.1, 93.1, 52/653.1, 655.1, 79.1, 79.6, 244, 76, 77, 52/5, 6, 16; 160/22, 45, 47, 353, 371, 184, 160/196.1; 135/114

See application file for complete search history.

(56) References Cited

U.S. PATENT DOCUMENTS

| | | | | |
|---|---|---|---|---|
| 2,908,053 | A * | 10/1959 | Gilman et al. | 52/73 |
| 3,071,825 | A * | 1/1963 | Ferris | 49/127 |
| 3,441,076 | A * | 4/1969 | Glejf et al. | 160/196.1 |
| 4,060,119 | A * | 11/1977 | Nohmura et al. | 160/266 |
| 4,258,511 | A * | 3/1981 | Strain | 52/79.1 |
| 4,692,847 | A * | 9/1987 | Gandy | 362/152 |
| 4,831,792 | A * | 5/1989 | Berger | 52/66 |
| 5,044,131 | A * | 9/1991 | Fisher | 52/63 |
| 5,577,830 | A * | 11/1996 | Barry et al. | 362/152 |
| 7,007,429 | B2 * | 3/2006 | Kim | 52/16 |
| 7,520,091 | B2 * | 4/2009 | Friedman | 52/63 |
| 7,730,695 | B2 * | 6/2010 | Brady | 52/715 |
| 2002/0139079 | A1 * | 10/2002 | Brady | 52/653.1 |
| 2004/0074157 | A1 * | 4/2004 | Chazal | 52/66 |
| 2005/0241779 | A1 * | 11/2005 | Abouloukme | 160/122 |
| 2009/0031641 | A1 * | 2/2009 | Grazioso | 52/74 |

FOREIGN PATENT DOCUMENTS

WO WO 02/092938 A 11/2002

* cited by examiner

*Primary Examiner* — Andrew Triggs

(74) *Attorney, Agent, or Firm* — Modiano & Associati; Albert Josif; Daniel J. O'Byrne

(57) ABSTRACT

A structure for outdoor marquees, pergolas and the like, of the type that comprises at least one supporting post with a substantially vertical arrangement, which is associated with at least one beam which can have an even slightly inclined arrangement. The beam comprises two mutually opposite profiles having a substantially U-shaped cross-section, the first profile, which is superimposed on the second profile and faces it, accommodating elements for moving a marquee associated with the structure, the second profile constituting a path for collecting rainwater that drains off the marquee in order to convey it to a drainage path.

6 Claims, 3 Drawing Sheets

STRUCTURE FOR OUTDOOR MARQUEES, PERGOLAS AND THE LIKE

BACKGROUND OF THE INVENTION

Outdoor marquees, and similar structures, are increasingly widespread, since the most recent models are capable of protecting users even against the most disparate atmospheric agents, without being limited only to the creation of a shaded area.

Known types of structures, despite having these functional characteristics, are often rendered unusable by insufficient overall rigidity. Protection from the sun in fact requires the structure to do nothing more than bear its own weight; protecting users from wind or rain (snow) instead produces an important mechanical load on the marquee, which is transferred to the structure.

Known types of solution therefore require "reinforcements" in order to bear effectively these mechanical loads of atmospheric origin.

Having a basic structure and a plurality of reinforcement elements suitable to adapt it to the various types of application is particularly awkward in terms of logistics: it is necessary to have available an extensive store with a large number of components for specific use.

Moreover, the fact that a structure that is adapted to protect its users against rain must also drain rainwater should not be forgotten: the marquee, once extended, must have a slope in order to drain the water. At this point it will be necessary to provide piping that is external to the structure in order to convey the water into appropriate drainpipes.

External piping is an obvious overall worsening of the appearance of the structure and in any case requires the manufacturer to keep in store a plurality of components designed exclusively for this purpose.

SUMMARY OF THE INVENTION

The aim of the present invention is to solve the above-mentioned drawbacks, by providing a structure for outdoor marquees, pergolas and the like with high structural strength.

Within this aim, an object of the invention is to provide a structure for outdoor marquees, pergolas and the like that is constituted by a minimum number of components in order to minimize store reserves.

Another object of the invention is to provide a structure for outdoor marquees, pergolas and the like that is adapted to collect and convey, for example into the sewer system, rainwater without requiring external piping.

Another object of the present invention is to provide a structure for outdoor marquees, pergolas and the like that has a low cost, is relatively simple to provide in practice, and is safe in application.

This aim and these and other objects, which will become better apparent hereinafter, are achieved by a structure for outdoor marquees, pergolas and the like, of the type that comprises at least one supporting post with a substantially vertical arrangement, which is associated with at least one beam which can have an even slightly inclined arrangement, characterized in that said beam comprises two mutually opposite profiles having a substantially U-shaped cross-section, the first profile, which is superimposed on the second one and faces it, accommodating elements for moving the marquee associated with said structure, the second profile constituting a path for collecting rainwater that drains off said marquee in order to convey it to a drainage path.

BRIEF DESCRIPTION OF THE DRAWINGS

Further characteristics and advantages of the invention will become better apparent from the following detailed description of a preferred but not exclusive embodiment of the structure for outdoor marquees, pergolas and the like according to the invention, illustrated by way of non-limiting example in the accompanying drawings, wherein.

DESCRIPTION OF THE PREFERRED EMBODIMENTS

Figure 1:
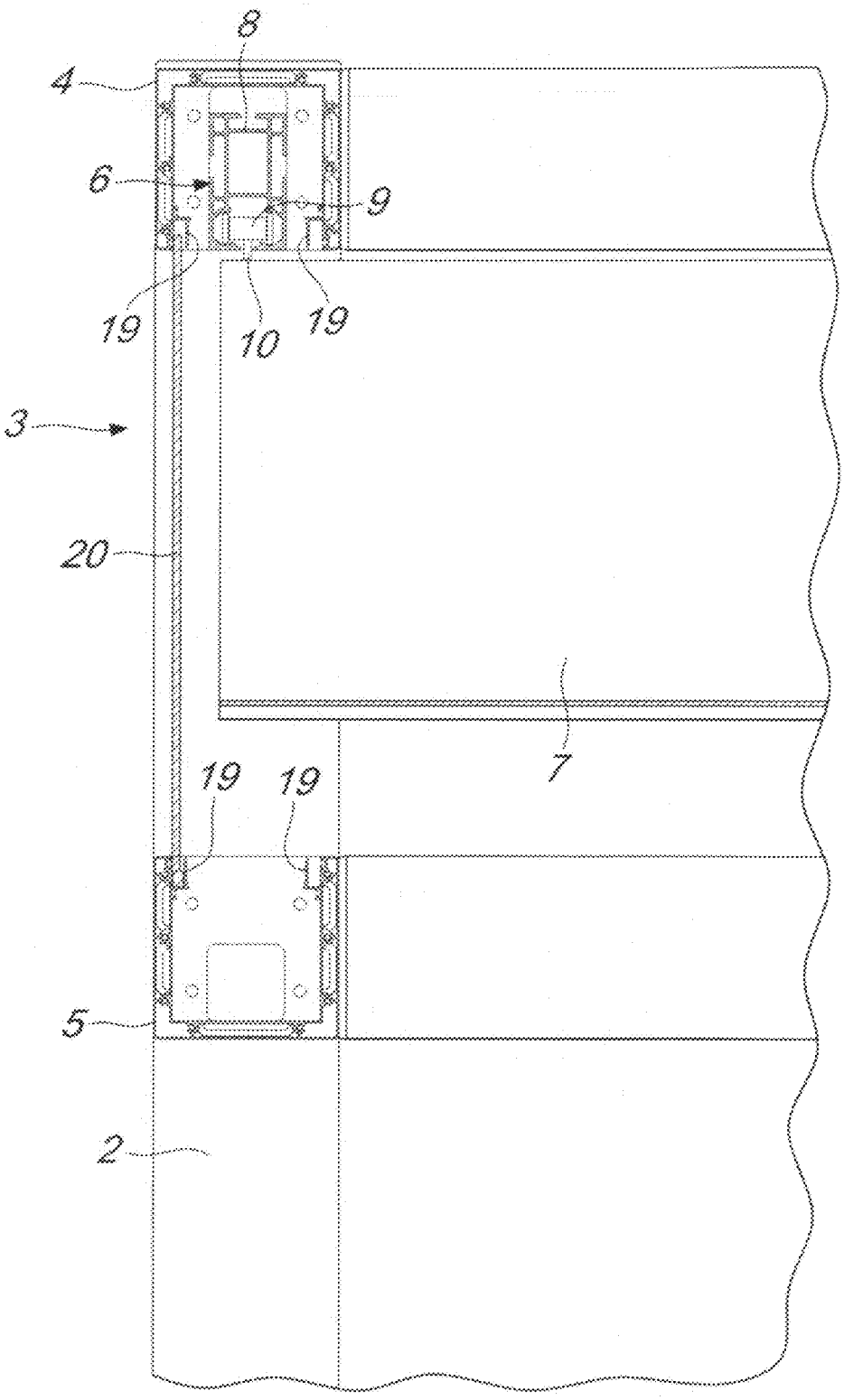
FIG. 1 is a sectional front view, taken along a transverse plane, of a portion of a structure for outdoor marquees, pergolas and the like according to the invention.
Figure 2:
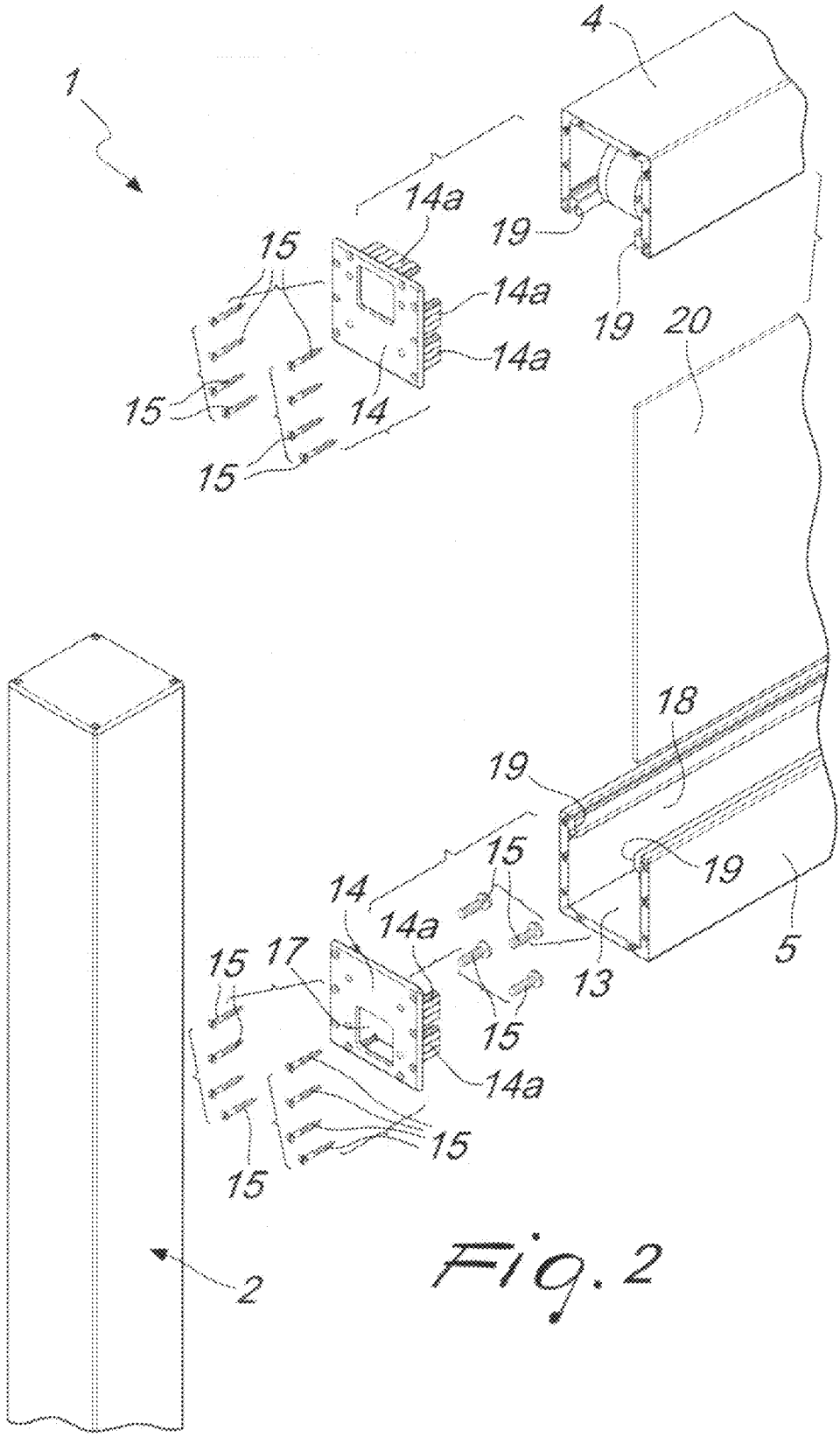
FIG. 2 is an exploded perspective view of a portion of a structure for outdoor marquees, pergolas and the like according to the invention.
Figure 3:
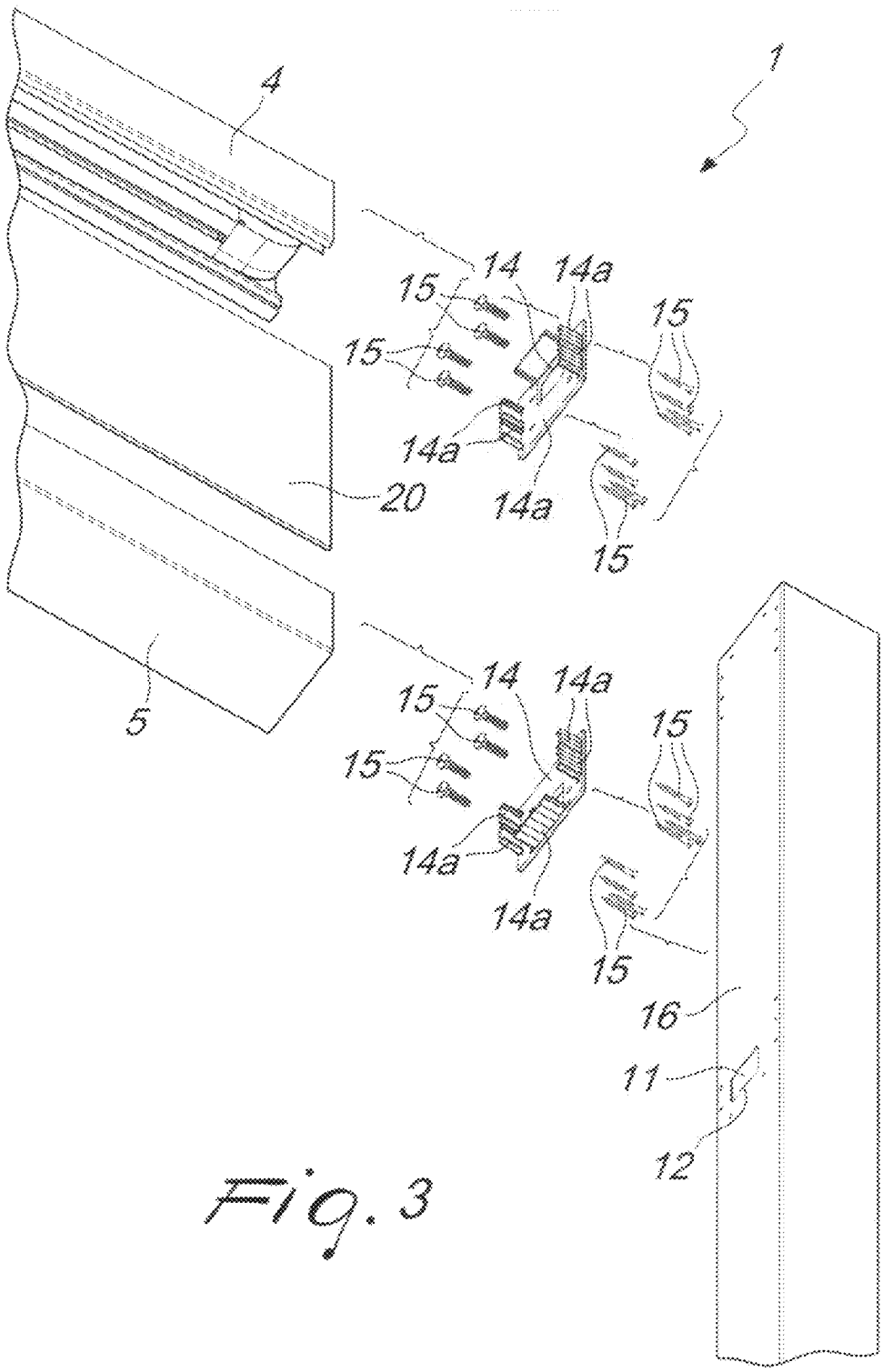
FIG. 3 is an exploded perspective view, taken from a different viewpoint, of a portion of the structure for outdoor marquees, pergolas and the like according to the invention.

With reference to the figures, the reference numeral 1 generally designates a structure for outdoor marquees, pergolas and the like.

The structure 1 comprises at least one supporting post 2, with a substantially vertical arrangement, which is associated with at least one beam 3 with an even slightly inclined arrangement. The beam 3 can be "suspended" between two successive posts 2 or can be coupled to a wall at an initial end and be supported by the post 2 at its terminal end.

The beam 3, according to the particular inventive concept of the present invention, comprises two mutually opposite profiles 4 and 5, which have a substantially U-shaped cross-section. The profiles 4 and 5 are provided internally with stiffening ribs intended to increase the structural properties of each profile 4 and 5; further, such ribs allow stable engagement of fixing elements such as screws, nails, pins and the like.

The first profile 4 is superimposed on the second profile 5 and faces it; the profile 4 accommodates elements 6 for moving a marquee 7 that is associated with the structure 1.

In particular, according to the embodiment shown in the accompanying figures, the movement elements 6 comprise a longitudinally extended element 8 which is contoured conveniently for stable accommodation within the profile 5; the element 8 constitutes a guide for a carriage 9, to which the marquee 7 is coupled by means of suitable arms 10.

The second profile 5 constitutes a path for collecting the rainwater that drains off the marquee 7 to convey it to a drainage path. The inclination of the marquee 7 when it is stretched (but also when it is gathered and water collects between the vaults formed by two contiguous supporting cross-members) ensures that such water is drained laterally with respect to it; in particular, the water falls inside the second profile 5 and is collected by it thanks to its U-shaped configuration, which makes it similar to a conveyance pipe.

Of course, the materials selected to provide the profiles 4 and 5 and the other accessories associated therewith are such as to ensure high stability even in the continuous presence of water. In particular, for applications that are adjacent to a marine coast, it is convenient to adopt materials that are insensitive to briny mist (or in any case materials that have been subjected beforehand to surface treatments that make them impervious to such agents).

The at least one post 2 is constituted by at least one at least partially hollow quadrangular profile: in particular, according to the embodiment shown in the accompanying figures, the quadrangular profile is a parallelepiped with a square base.

The quadrangular profile comprises at least one opening 11, which is aligned with the portion for mating the second profile 5 to the quadrangular profile (post 2).

A lower base 12 of the opening 11 is arranged at the same height as an internal surface 13 of the second profile 5.

The opening 11 ensures collection of the rainwater that is conveyed by the second profile 5 and its conveyance through the internal cavity (which is not visible in the accompanying figures) of the quadrangular profile (post 2) and its discharge into respective external systems (which can be constituted by the local sewage system but can also have respective dispersion wells that release the water directly into the soil that surrounds the area where the structure 1 is installed).

The structure 1 further comprises respective end covers 14, which are suitable for stable interlocking mating (wings 14*a* engage within appropriately provided slotted seats formed on the front of the respective profile 4 or 5) with the front of each U-shaped profile 4 and 5. The covers 14 ensure the closure of each profile 4 and 5 and therefore prevent, in the case of the profile 4, the entry of foreign objects that might hinder the operation of the movement elements 6 and, in the case of the profile 5, the outflow of water by lateral seepage.

The end covers 14 in fact comprise appropriately provided containment seats for means 15 for fixing to a surface 16 of the quadrangular profile (post 2).

Each cover 14 comprises a port 17, which is perfectly aligned, when the cover 14 is mounted on the profile 5 and such profile is correctly coupled to the quadrangular profile (post 2), with the opening 11. The rainwater conveyed by the profile 5 can pass through the port 17 and the opening 11 in order to access the internal cavity of the quadrangular profile (post 2) through which it is eliminated.

Conveniently, each U-shaped profile 4 and 5 comprises, at an internal surface 18, particularly in the area that lies proximate to the end edge of each of its side walls, at least one L-shaped frame 19 that constitutes a receptacle.

According to an embodiment of particular interest in practice and in application, a panel 20 which has a substantially rectangular shape and a very low thickness is interposed between the two U-shaped profiles 4 and 5, its mutually opposite perimetric edges being accommodated in the respective seats formed by the L-shaped frames 19.

The panel 20 can be coupled within the respective seats to increase the rigidity of the structure 1: the presence of the panel 20 is such as to mutually stiffen the two profiles 4 and 5, thus providing higher stability of the entire structure 1.

In order to ensure optimum aesthetic integration with respect to the remaining furnishing components that are present in the area where the structure 1 is installed, the panel 20 can be translucent or opaque according to the requirements (in the case of an opaque panel 20, any coloring or combination of colorings is possible).

Conveniently, the panel 20 protects the marquee 7 against gusts of wind; this shielding function subjects the marquee 7 to smaller mechanical stresses both when it is extended and when it is gathered.

The invention thus conceived is susceptible of numerous modifications and variations, all of which are within the scope of the appended claims; all the details may further be replaced with other technically equivalent elements.

In the exemplary embodiments shown, individual characteristics, given in relation to specific examples, may actually be interchanged with other different characteristics that exist in other exemplary embodiments.

Moreover, it is noted that anything found to be already known during the patenting process is understood not to be claimed and to be the subject of a disclaimer.

In practice, the materials used, as well as the contingent shapes and dimensions, may be any according to requirements and to the state of the art.

The disclosures in European Patent Application No. 08425822.7 from which this application claims priority are incorporated herein by reference.

What is claimed is:

1. A structure for outdoor marquees, pergolas and other structures for protection of users against atmospheric agents, that comprises at least one supporting post constituted by at least one quadrangular profile with a substantially vertical arrangement, which is associated with at least one beam, said beam having a slightly inclined arrangement, wherein said beam comprises a first and a second mutually opposite profiles having each a substantially U-shaped cross-section and a front, said front being stably interlocking mated with respective end covers to ensure the closure of each one of said profiles, each one of said end covers comprising receptacles in which fixing means for fixing the end covers to a surface of said quadrangular profile are insertable and a port, the first profile being an upper profile which is superimposed on the second profile that is a lower profile, said first, upper profile facing said second, lower profile, said first, upper profile further accommodating elements for moving a marquee associated with said structure, the second, lower profile constituting a path for collecting rainwater that drains off said marquee in order to convey said drainwater to a drainage path, and wherein said at least one quadrangular profile is at least partially hollow and has an internal cavity that forms said drainage path and comprises at least one opening provided at a side region thereof that is aligned with a portion of said second, lower profile and with said port of a said end cover for mating the second, lower profile with said quadrangular profile, said opening having a lower base arranged at a same height as an internal surface of said second, lower profile, in order to collect rainwater conveyed by said second, lower profile, through said port of the end cover, convey the water through the internal cavity of the quadrangular profile that forms said drainage path and discharge the water into respective external systems.

2. The structure according to claim 1, wherein each U-shaped profile comprises, at an internal surface, which lies proximate to the end edge of each of its side walls, at least one L-shaped frame which constitutes a receptacle.

3. The structure according to claim 2, wherein a substantially rectangular panel of limited thickness is interposed between the two U-shaped profiles, mutually opposite perimetric edges of said panel being accommodated on respective seats formed by the L-shaped frames.

4. The structure according to claim 3, wherein said panel is coupled within the respective seats to increase the rigidity of the structure.

5. The structure according to claim 3, wherein said panel is translucent.

6. The structure according to claim 3, wherein said panel is opaque.

* * * * *